US009766573B1

(12) United States Patent
Shinozaki et al.

(10) Patent No.: US 9,766,573 B1
(45) Date of Patent: Sep. 19, 2017

(54) DEVELOPER VESSEL AND IMAGE FORMING APPARATUS

(71) Applicant: FUJI XEROX CO., LTD., Tokyo (JP)

(72) Inventors: Seigo Shinozaki, Ebina (JP); Keisuke Kubo, Ebina (JP); Hideki Kuge, Ebina (JP); Makoto Kanno, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/257,195

(22) Filed: Sep. 6, 2016

(30) Foreign Application Priority Data

Mar. 8, 2016 (JP) ..... 2016-044568

(51) Int. Cl.
*G03G 15/08* (2006.01)

(52) U.S. Cl.
CPC ..... *G03G 15/0867* (2013.01)

(58) Field of Classification Search
CPC ..... G03G 15/0837; G03G 15/0872; G03G 21/1642; G03G 21/1676; G03G 21/1821; G03G 21/1842; G03G 21/185; G03G 2221/1651; G03G 2221/1654; G03G 2221/1861; G03G 2215/0665; G03G 2215/0673; G03G 2221/1884
See application file for complete search history.

(56) References Cited

U.S. PATENT DOCUMENTS 5,455,662 A * 10/1995 Ichikawa ..... G03G 15/0872 141/357
5,627,631 A * 5/1997 Ichikawa ..... G03G 15/0868 222/DIG. 1
5,822,663 A * 10/1998 Ichikawa ..... G03G 15/0872 215/384
5,918,090 A * 6/1999 Ichikawa ..... G03G 15/0868 215/382
8,792,809 B2 * 7/2014 Kenji ..... G03G 15/0886 399/262
2001/0055498 A1 * 12/2001 Matsuzaki ..... G03G 21/185 399/111
2004/0131389 A1 7/2004 Tazawa et al.
(Continued)

FOREIGN PATENT DOCUMENTS

JP 03132768 A * 6/1991 ..... G03G 21/1846
JP 2003-295591 A 10/2003
JP 2004-138694 A 5/2004

*Primary Examiner* — Sevan A Aydin
(74) *Attorney, Agent, or Firm* — Oliff PLC

(57) ABSTRACT

A developer vessel includes a container that includes a discharge port through which developer is discharged, and a transport portion that rotates to transport the developer toward the discharge port, a first protrusion that protrudes from an outer surface of the container, a second protrusion that protrudes from the outer surface at a position on an opposite side to the first protrusion with a virtual line being interposed between the first and second protrusions, the virtual line passing through a rotational axis of the transport portion and on a plane perpendicular to the rotational axis of the transport portion and being parallel to the discharge port, and an extending portion that is disposed at an outer end of each of the first and second protrusions on the plane and that extends in a direction intersecting with the respective first and second protrusions.

3 Claims, 11 Drawing Sheets

(56) References Cited

U.S. PATENT DOCUMENTS

| | | | | |
|---|---|---|---|---|
| 2006/0239712 | A1* | 10/2006 | Yamaguchi | G03G 21/185 399/111 |
| 2006/0285879 | A1* | 12/2006 | Yamaguchi | G03G 21/185 399/111 |
| 2008/0118278 | A1* | 5/2008 | Takesue | G03G 15/0872 399/263 |
| 2008/0317510 | A1* | 12/2008 | Choi | G03G 15/0877 399/262 |
| 2009/0016779 | A1* | 1/2009 | Hwang | G03G 15/0855 399/258 |
| 2009/0092415 | A1* | 4/2009 | Murakami | G03G 15/0872 399/119 |
| 2010/0098456 | A1* | 4/2010 | Murase | G03G 15/0872 399/110 |
| 2011/0243579 | A1* | 10/2011 | Oshikawa | G03G 21/1875 399/12 |
| 2012/0045244 | A1* | 2/2012 | Komatsu | G03G 15/0839 399/119 |
| 2012/0275823 | A1* | 11/2012 | Mizuno | G03G 21/185 399/111 |
| 2014/0064794 | A1* | 3/2014 | Takahashi | G03G 15/0886 399/262 |
| 2016/0004184 | A1* | 1/2016 | Kikuchi | G03G 15/0872 399/258 |
| 2016/0091825 | A1* | 3/2016 | Oba | G03G 15/0886 399/254 |
| 2016/0259267 | A1* | 9/2016 | Horii | G03G 15/0872 |
| 2016/0259270 | A1* | 9/2016 | Oba | G03G 15/0872 |
| 2016/0274493 | A1* | 9/2016 | Horii | G03G 15/0872 |

* cited by examiner

DEVELOPER VESSEL AND IMAGE FORMING APPARATUS

CROSS-REFERENCE TO RELATED APPLICATIONS

This application is based on and claims priority under 35 USC 119 from Japanese Patent Application No. 2016-044568 filed Mar. 8, 2016.

BACKGROUND

Technical Field

The present invention relates to a developer vessel and an image forming apparatus.

SUMMARY

According to an aspect of the invention, a developer vessel includes a container that contains developer and includes a discharge port through which the developer is discharged, and a transport portion that rotates to transport the developer toward the discharge port, a first protrusion that protrudes from an outer surface of the container, a second protrusion that protrudes from the outer surface of the container at a position on an opposite side to the first protrusion with a virtual line being interposed between the first and second protrusions, wherein the virtual line passes through a rotational axis of the transport portion and on a plane perpendicular to the rotational axis of the transport portion and is parallel to the discharge port, and an extending portion that is disposed at an outer end of each of the first and second protrusions on the plane perpendicular to the rotational axis and that extends in a direction intersecting with the respective first and second protrusions and in a direction of being apart from the virtual line.

BRIEF DESCRIPTION OF THE DRAWINGS

Exemplary embodiments of the present invention will be described in detail based on the following figures, wherein.

DETAILED DESCRIPTION

Next, a specific example (hereinafter, referred to as Example) of an exemplary embodiment of the invention is described with reference to the figures; however, the invention is not limited to the following examples.

For easy understanding of the following description, in the figures, a frontward-rearward direction is referred to as an X axial direction, a rightward-leftward direction is referred to as a Y axial direction, an upward-downward direction is referred to as a Z axial direction, and directions or sides represented by arrows X, −X, Y, −Y, Z, and −Z are referred to as frontward, rearward, rightward, leftward, upward, downward, or the front side, the rear side, the right side, the left side, the upper side, and the lower side.

In addition, in the figures, "O" with "●" at the center thereof represents an arrow directed from the back of the paper surface to the front thereof and "O" with "x" at the center thereof represents an arrow directed from the front of the paper surface to the back thereof.

In the following description with reference to the figures, component members, which need not to be described, are appropriately omitted in the figures for easy understanding.

Example 1

Figure 1:
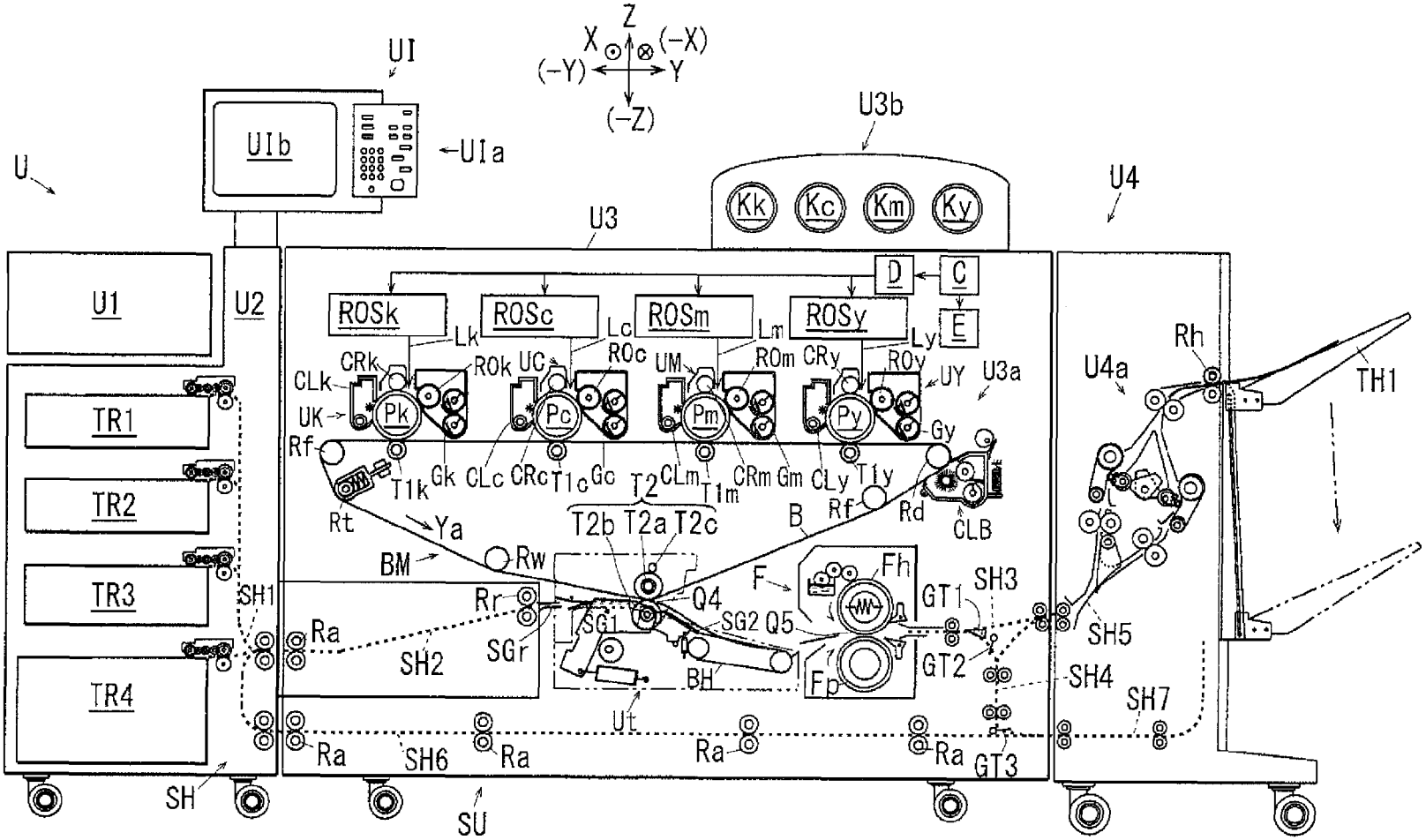
FIG. 1 is a view depicting the entirety of an image forming apparatus of Example 1.

FIG. 1 is a view depicting the entirety of an image forming apparatus of Example 1.

Figure 2:
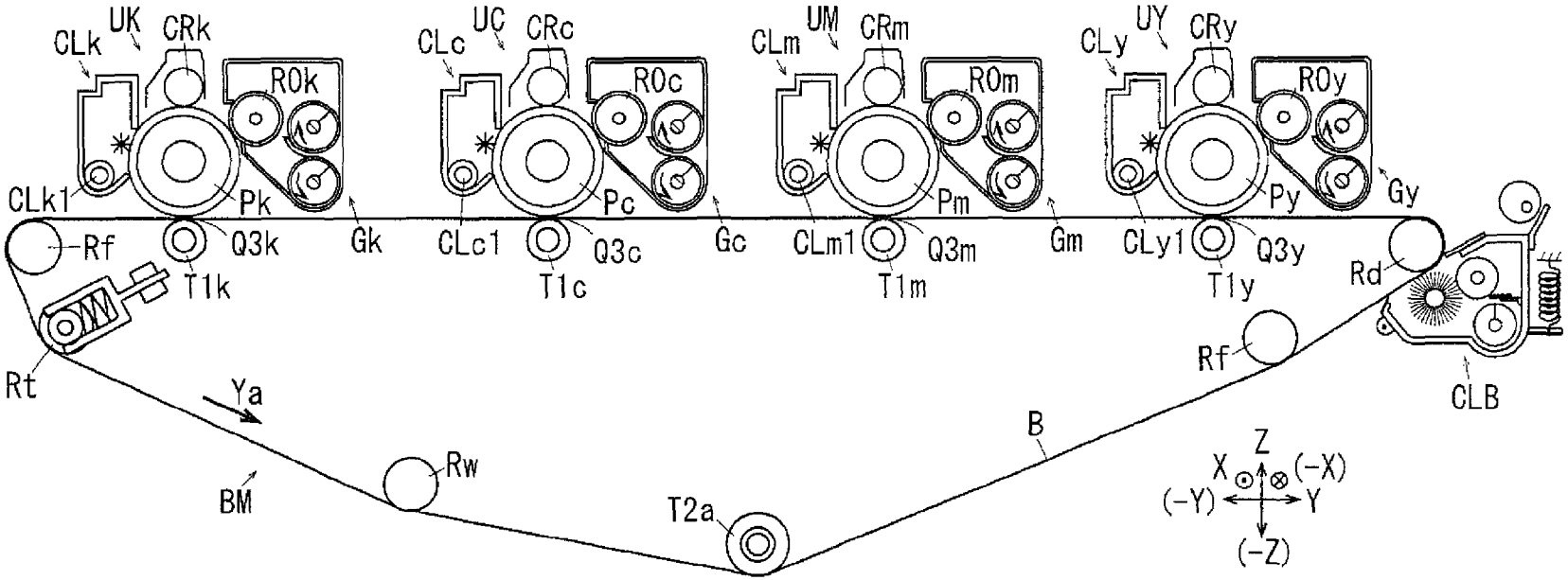
FIG. 2 is an enlarged view depicting a visible-image forming device of Example 1.

FIG. 2 is an enlarged view depicting a visible-image forming device of Example 1.

In FIG. 1, a copier U as an example of the image forming apparatus includes an operating device UI, a scanner U1 as an example of an image reader, a feeder U2 as an example of a medium supply device, an image forming section U3 as an example of an image recording device, and a medium processing device U4.

Description of Operating Device UI

The operating device UI includes an input button UIa that is used for starting copying and setting the number of copies. In addition, the operating device UI includes a display UIb on which details input by the input button UIa or a state of the copier U is displayed.

Description of Feeder U2

In FIG. 1, the feeder U2 includes plural sheet feeding trays TR1, TR2, TR3, and TR4 as examples of a medium container. In addition, the feeder U2 includes a medium supply path SH1 or the like, brings out a recording sheet S as an example of a medium for recording an image, which is contained in each of the sheet feeding trays TR1 to TR4, and transports the recording sheet S to the image forming section U3 through the medium support path.

Description of Image Forming Section U3 and Medium Processing Device U4

In FIG. 1, the image forming section U3 includes an image recording portion U3*a* that performs image recording on the recording sheet S transported from the feeder U2, based on an original-document image read by the scanner U1.

In FIGS. 1 and 2, a drive circuit D of a latent image forming device of the image forming section U3 outputs, at a preset time, a drive signal corresponding to image information input from the scanner U1 to each of the latent image forming devices ROSy, ROSm, ROSc, and ROSk, of respective colors Y to K. Photoconductor drums Py, Pm, Pc, and Pk as examples of an image carrier are arranged below the latent image forming devices ROSy to ROSk.

Surfaces of the rotating photoconductor drums Py, Pm, Pc, and Pk are uniformly charged by charging rolls CRy, CRm, CRc, and CRk as examples of a charging device. Electrostatic latent images are formed on the charged surfaces of the photoconductor drums Py to Pk by laser beams Ly, Lm, Lc, and Lk as examples of latent image writing light emitted from the latent image forming devices ROSy, ROSm, ROSc, and ROSk. The electrostatic latent images on the surfaces of the photoconductor drums Py, Pm, Pc, and Pk are developed into toner images as examples of visible images of yellow Y, magenta M, cyan C, and black K by developing devices Gy, Gm, Gc, and Gk.

Developer consumed through developing in the developing devices Gy to Gk is supplied from toner cartridges Ky, Km, Kc, and Kk as examples of a developer vessel. The toner cartridges Ky, Km, Kc, and Kk are detachably mounted in the developer supply device U3*b*.

The toner images on the surfaces of the photoconductor drums Py, Pm, Pc, and Pk are transferred to be superimposed by primary transfer rolls T1*y*, T1*m*, T1*c*, and T1*k* as examples of a primary transfer device in primary transfer regions Q3*y*, Q3*m*, Q3*c*, and Q3*k* on an intermediate transfer belt B as an intermediate transfer body, in this order, and a color toner image as an example of a multicolor visible image is formed on the intermediate transfer belt B. The color toner image formed on the intermediate transfer belt B is transported to a secondary transfer region Q4.

In a case of K image information, the photoconductor drum Pk of the K color and the developing device Gk are only used and only the K toner image is formed.

After the primary transfer, the photoconductor drums Py, Pm, Pc, and Pk are cleaned by drum cleaners CLy, CLm, CLc, and CLk as examples of a cleaning unit of the image carrier such that a residual substance such as residual developer or paper dust attached on the surfaces of the photoconductor drums is removed.

In Example 1, the photoconductor drum Pk, the charging roll CRk, and the drum cleaner CLk are integrated to form a photoconductor unit UK of the K color as an example of an image carrier unit. Similarly, for the other colors Y, M, and C, photoconductor units UY, UM, and UC respectively include the photoconductor drums Py, Pm, and Pc, the charging rolls CRy, CRm, and CRc, and the drum cleaners CLy, CLm, and CLc.

In addition, K visible-image forming device UK+Gk includes the photoconductor unit UK of the K color and the developing device Gk having a developing roll R0*k* as examples of a developer holing member. Similarly, Y, M, and C visible-image forming devices UY+Gy, UM+Gm, and UC+Gc respectively include the photoconductor units UY, UM, and UC of the Y, M, and C colors and the developing devices Gy, Gm, and Gc having developing rolls R0*y*, R0*m*, and R0*c*.

A belt module BM as an example of an intermediate transfer device is disposed below the photoconductor drums Py to Pk. The belt module BM includes the intermediate transfer belt B, a driving roll Rd as an example of a drive member of the intermediate transfer body, a tension roll Rt as an example of a tension applying member, a walking roll Rw as an example of a meandering prevention member, plural idler rolls Rf as examples of a driven member, a backup roll T2*a* as an example of a facing member, and primary transfer rolls T1*y*, T1*m*, T1*c*, and T1*k*. The intermediate transfer belt B is supported to be rotatable and movable in a direction of arrow Ya.

A secondary transfer unit Ut is disposed below the backup roll T2*a*. The secondary transfer unit Ut has a secondary transfer roll T2*b* as an example of a secondary transfer member. The secondary transfer region Q4 is formed by a region in which the secondary transfer roll T2*b* contacts with the intermediate transfer belt B. In addition, a backup roll as an example of the facing member faces the secondary transfer roll t2*b* with the intermediate transfer belt B being nipped therebetween. A contact roll T2*c* as an example of a power supply member contacts with the backup roll T2*a*. A secondary transfer voltage having the same polarity as a charging polarity of the toner is applied to the contact roll T2*c*.

A secondary transfer unit T2 includes the backup roll T2*a*, the secondary transfer roll T2*b*, and the contact roll T2*c*.

A medium transporting path SH2 is disposed below the belt module BM. The recording sheet S fed from the medium supply path SH1 of the feeder U2 is transported to a registration roll Rr as an example of an adjustment member of a transport time by a transporting roll Ra as an example of a medium transport member. The registration roll Rr transports the recording sheet S to the downstream side at the time when the toner image formed on the intermediate transfer belt B is transported to the secondary transfer region Q4. The recording sheet S sent out by the registration roll Rr is guided by a sheet guide SGr on the registration side and a sheet guide SG1 on the transfer side and is transported to the secondary transfer region Q4.

The toner image on the intermediate transfer belt B is transferred to the recording sheet S by the secondary transfer unit T2 when the toner image passes through the secondary transfer region Q4. In the case of the color toner image, the toner images primarily transferred to be superimposed on the surface of the intermediate transfer belt B are secondarily transferred to the recording sheet S in a collective manner.

Transfer devices T1*y* to T1*k*+T2+B of Example 1 include the primary transfer rolls T1*y* to T1*k*, the secondary transfer unit T2, and the intermediate transfer belt B.

After the secondary transfer, the intermediate transfer belt B is cleaned by a belt cleaner CLB as an example of an intermediate transfer body cleaning device disposed on the downstream side of the secondary transfer region Q4. The belt cleaner CLB removes, in the secondary transfer region Q4, a residual substance such as developer or paper dust that is not transferred but remains on the intermediate transfer belt B.

The recording sheet S, on which the toner image is transferred, is guided by the sheet guide SG2 after the transfer and is sent to a medium transport belt BH as an example of a transport member. The medium transport belt BH transports the recording sheet S to a fixing device F.

The fixing device F includes a heating roll Fh as an example of a heating member and a pressurizing roll Fp as an example of a pressurizing member. The recording sheet S is transported to a fixing region Q5 formed in a region in which the heating roll Fh and the pressurizing roll Fp contact with each other. The toner image on the recording sheet S is heated and pressurized to be fixed by the fixing device F when the toner image passes through the fixing region Q5.

The image recording portion U3*a* of Example 1 includes the visible image forming devices UY+Gy to UK+Gk, the transfer devices T1*y* to T1*k*+T2+B, and the fixing device F.

A switching gate GT1 as an example of a switching member is provided on the downstream side of the fixing device F. The switching gate GT1 selectively switches between an output path SH3 on the medium processing device U4 or a reverse path SH4 through which the recording sheet S is transported after the recording sheet passes the fixing region Q5. The recording sheet S transported through the output path SH3 is transported to a sheet transporting path SH5 of the medium processing device U4. A curl straightening member U4*a* as an example of a fold straightening member is disposed in the sheet transporting path SH5. The curl straightening member U4*a* straightens a fold, that is, a so-called curl of the transported recording sheet S. The recording sheet S after the straightening of the curl is output to an output tray TH1 as an example of a medium output portion, with an image fixed surface of the sheet faced upward, by an output roll Rh as an example of a medium output member.

The recording sheet S transported to the reverse path SH4 side of the image forming section U3 by the switching gate GT1 is transported to the reverse path SH4 side of the image forming section U3 by passing through a second gate GT2 as an example of a switching member.

At this time, in a case where the recording sheet S is output with the image fixed surface facing downward, the transport direction of the recording sheet S is reversed after a trailing end of the recording sheet S in a transport direction passes through the second gate GT2. Here, the second gate GT2 of Example 1 includes an elastic member having a thin film shape. Hence, the second gate GT2 allows the recording sheet S transported on the reverse path SH4 to pass therethrough once as it is. Then, when the recording sheet S is reversed (that is, subjected to so-called switching back) after passing through the second gate, the second gate GT2 guides the recording sheet S to the transporting paths SH3 and SH5 sides. Then, the recording sheet S, which is subjected to switching back, passes through the curl straightening member U4*a* and is output to the output tray TH1 with the image fixed surface facing downward.

A loop path SH6 is connected to the reverse path SH4 of the image forming section U3 and a third gate GT3 as an example of a switching member is disposed in the connection portion. In addition, an end of the reverse path SH4 on the downstream side is connected to a reverse path SH7 of the medium processing device U4.

The recording sheet S transported to the reverse path SH4 through the switching gate GT1 is transported by the third gate GT3 to the reverse path SH7 side of the medium processing device U4. Similar to the second gate GT2, the third gate GT3 of Example 1 includes an elastic member having a thin film shape. Hence, the third gate GT2 allows the recording sheet S transported on the reverse path SH4 to pass therethrough once. Then, when the recording sheet S is subjected to switching back after passing through the 3rd gate GT3, the third gate GT3 guides the recording sheet S to the loop path SH6 side.

The recording sheet S transported to the loop path SH6 is resent to the secondary transfer region Q4 with passing through the medium transporting path SH2, and printing is performed on the second surface.

A sheet transporting path SH includes elements represented by the reference signs SH1 to SH7. In addition, a sheet transport device SU of Example 1 includes elements represented by the reference signs SH, Ra, Rr, Rh, SGr, SG1, SG2, BH, and GT1 to GT3.

Description of Developer Supply Device U3*b*

Figure 3:
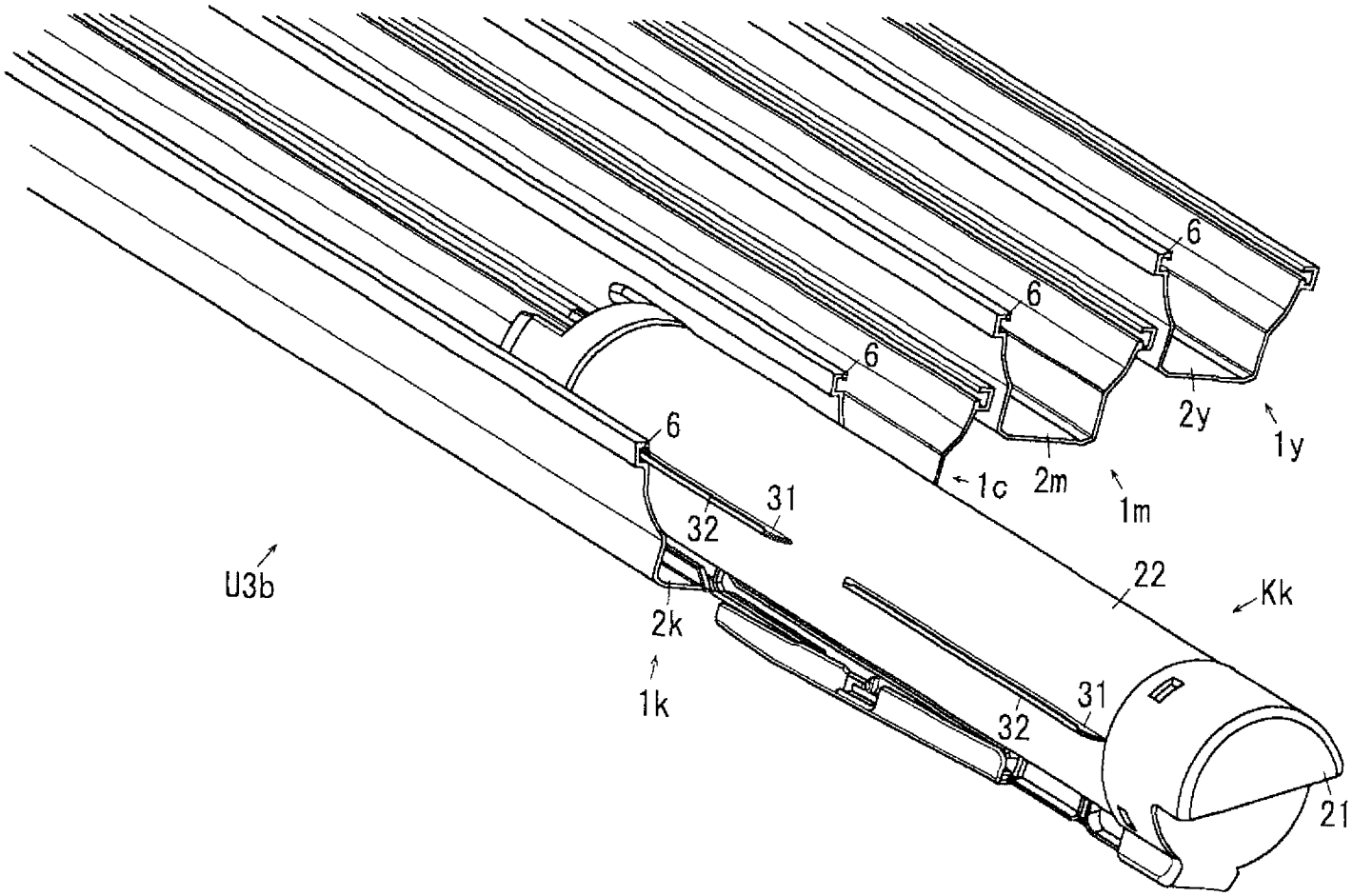
FIG. 3 is a view depicting a developer supply device of Example 1.

FIG. 3 is a view depicting the developer supply device of Example 1.

Figure 4:
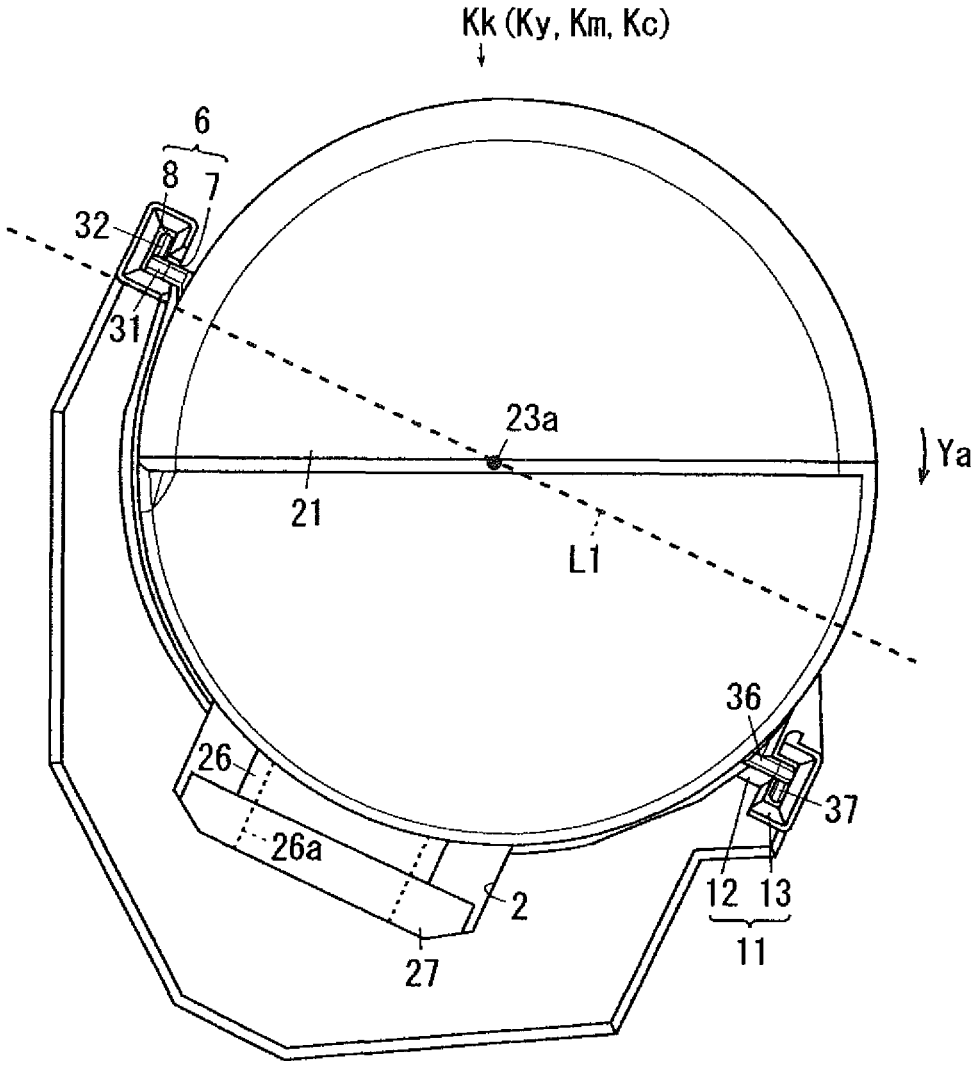
FIG. 4 is a view of the developer supply device of Example 1 when viewed from the front side.

FIG. 4 is a view of the developer supply device of Example 1 when viewed from the front side.

In FIGS. 3 and 4, the developer supply device U3*b* of Example 1 includes holder portions 1*y*, 1*m*, 1*c*, and 1*k* as examples of a holding portion. The holder portions 1*y* to 1*k* are provided to correspond to the Y, M, C and K toner cartridges Ky to Kk. Each of the holder portions 1*y* to 1*k* is formed to have a semi-cylindrical shape extending in the frontward-rearward direction. In Example 1, the holder portion 1*k* of K color is formed to be bigger than the other holder portions 1*y* to 1*c* of the other colors.

In the following description, the holder portions 1*y* to 1*k* and the toner cartridges Ky to Kk have the same configuration except for the sizes of a part of the holder portions and the toner cartridges. Accordingly, the holder and the toner cartridge of the K color are described and subscripts y, m, c, and k are omitted in the description.

A shutter passing groove 2 as an example of an opening-closing member passing portion is formed in a lower left portion of each holder portion 1. The shutter passing groove 2 is formed to have a shape protruding to the lower left side. An inlet port (not illustrated) is formed in a rear portion of the shutter passing groove 2. In addition, a supply motor and a gear train (not illustrated) as an example of a driving source are disposed in a rear end portion of each holder portion 1. The supply motor or the like drives the toner cartridge Kk.

Figure 5:
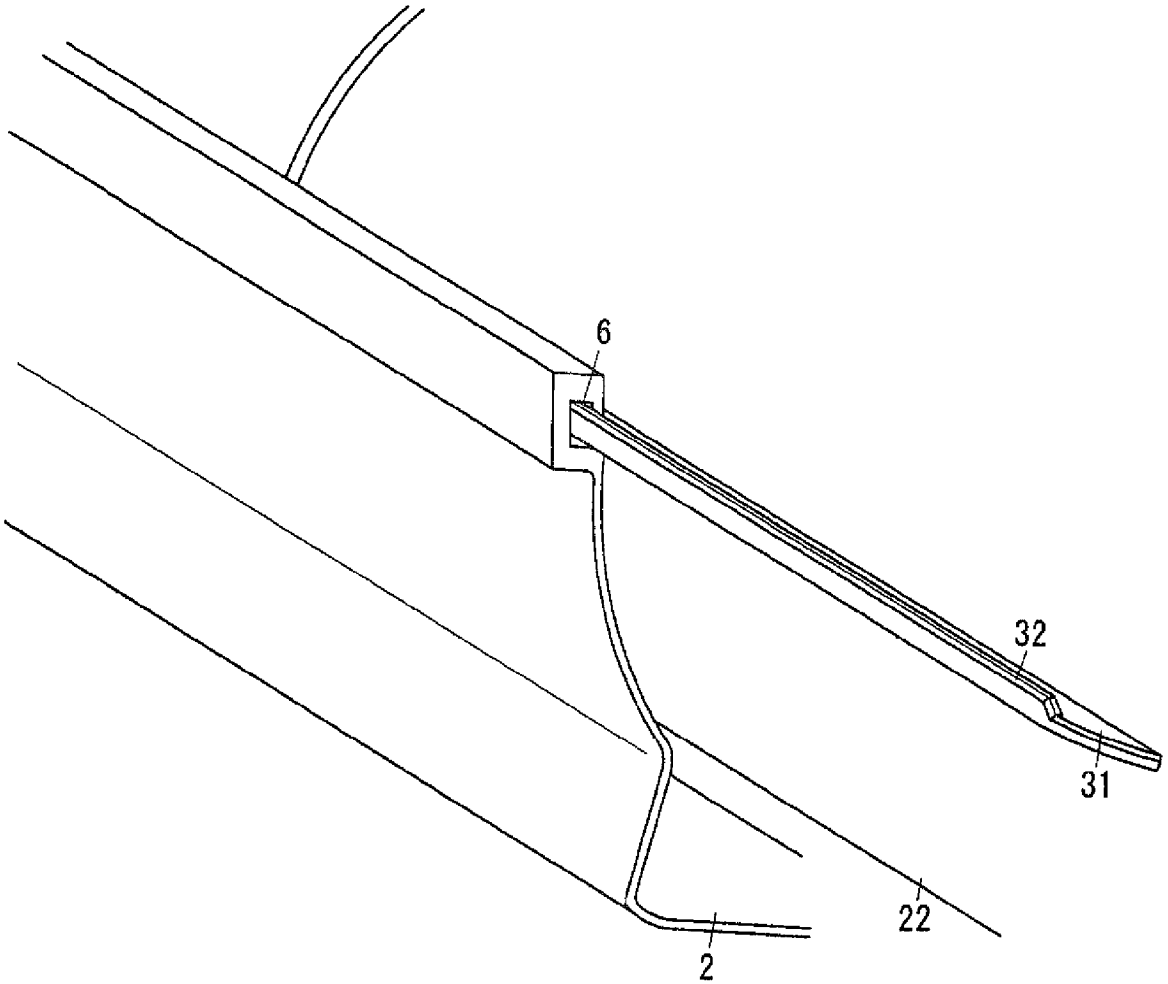
FIG. 5 is an enlarged view of a major part of a guide portion of the developer supply device.

FIG. 5 is an enlarged view of a major part of a guide portion of the developer supply device.

Figure 6:
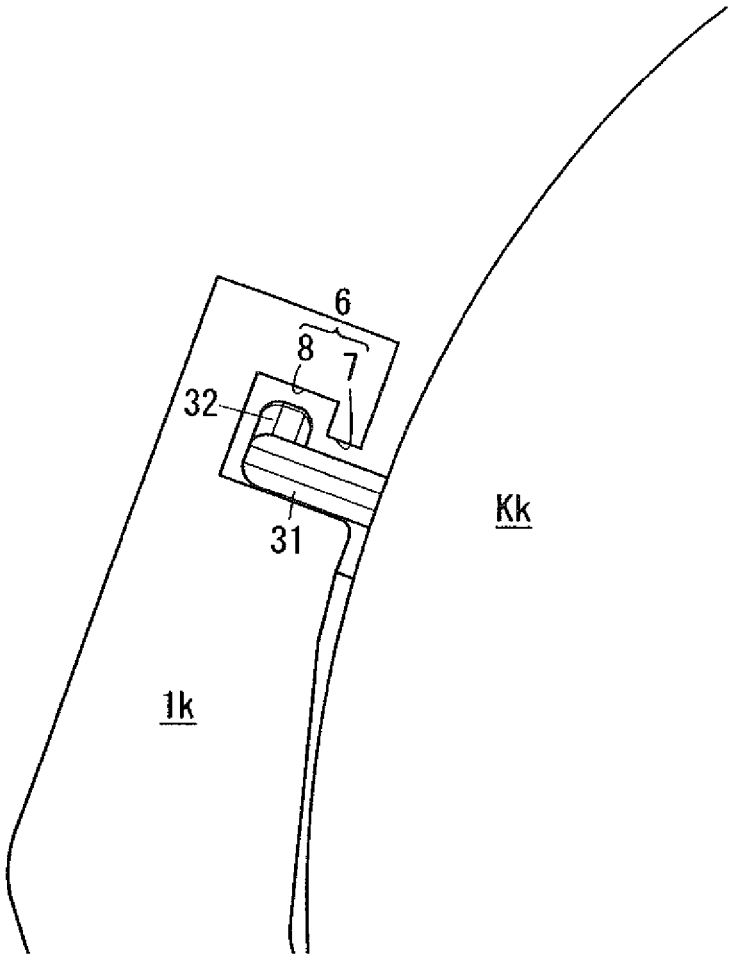
FIG. 6 is an enlarged view of a major part of a left-side guide portion of the developer supply device of Example 1.

FIG. 6 is an enlarged view of a major part of a left-side guide portion of the developer supply device of Example 1.

In FIGS. 3 to 6, a left guide rail 6 as an example of a first guide portion is formed in an upper left portion of each holder portion 1. In FIGS. 5 and 6, the left guide rail 6 includes a slit portion 7 as an example of a connection portion, and a left rail main body 8 as an example of a first guide portion main body. The left rail main body 8 is formed to penetrate through the holder portion 1 in the frontward-rearward direction. The slit portion 7 is formed to penetrate through the holder in the frontward-rearward direction so as to connect a lower right portion of the left rail main body 8 and an inner surface of the holder portion 1. Accordingly, as illustrated in FIG. 6, the left guide rail 6 is formed to have substantially an L shape as a whole when viewed from the front side.

Figure 7:
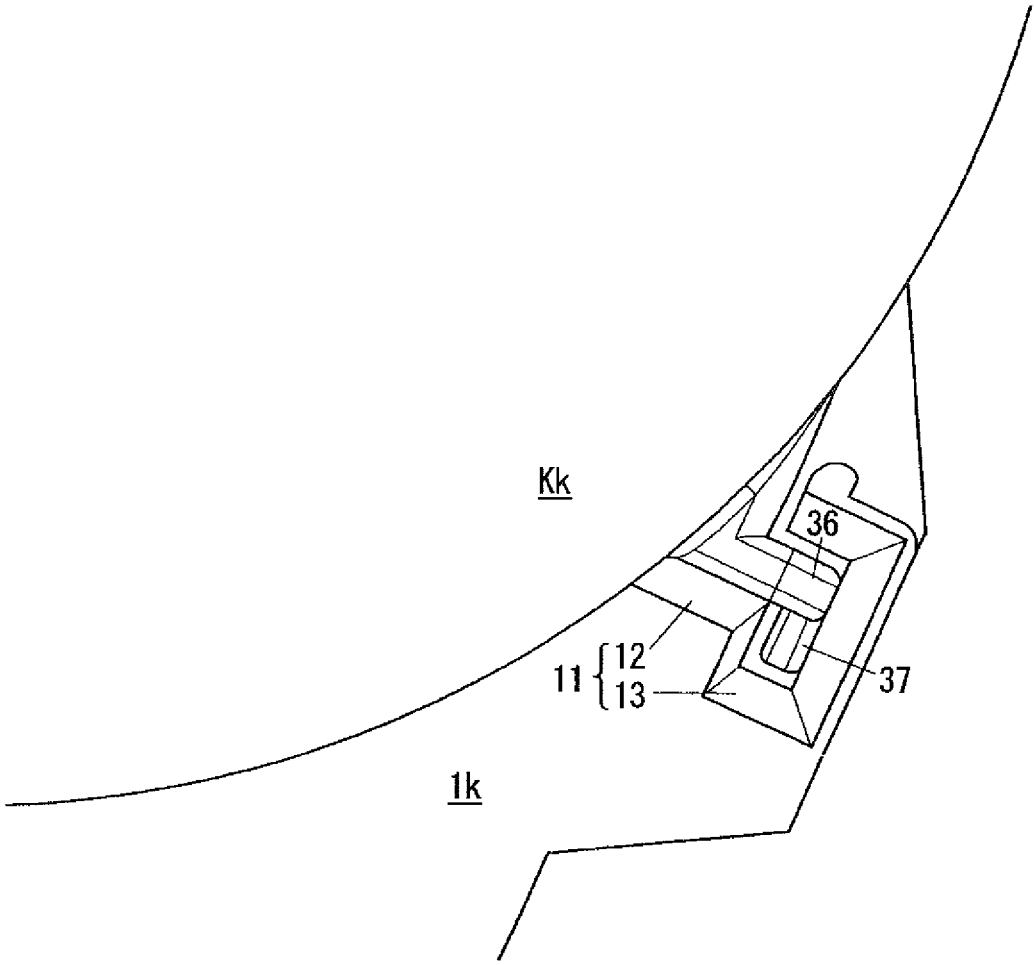
FIG. 7 is an enlarged view of a major part of a right-side guide portion of the developer supply device of Example 1.

FIG. 7 is an enlarged view of a major part of a right-side guide portion of the developer supply device of Example 1.

In FIGS. 3, 4, and 7, a right guide rail 11 as an example of a second guide portion is formed in a lower right portion of each of the holder portion 1. In FIG. 7, the right guide rail 11 includes a slit portion 12 as an example of a connection portion, and a right rail main body 13 as an example of a second guide portion main body. The right rail main body 13 is formed to penetrate through the holder portion 1 in the frontward-rearward direction. The slit portion 12 is formed to penetrate in the frontward-rearward direction so as to connect an upper left end of the right rail main body 13 and an inner surface of the holder portion 1. Accordingly, as illustrated in FIG. 7, the right guide rail 11 is formed to have a substantially upside-down L shape as a whole when viewed from the front side.

Figure 8:
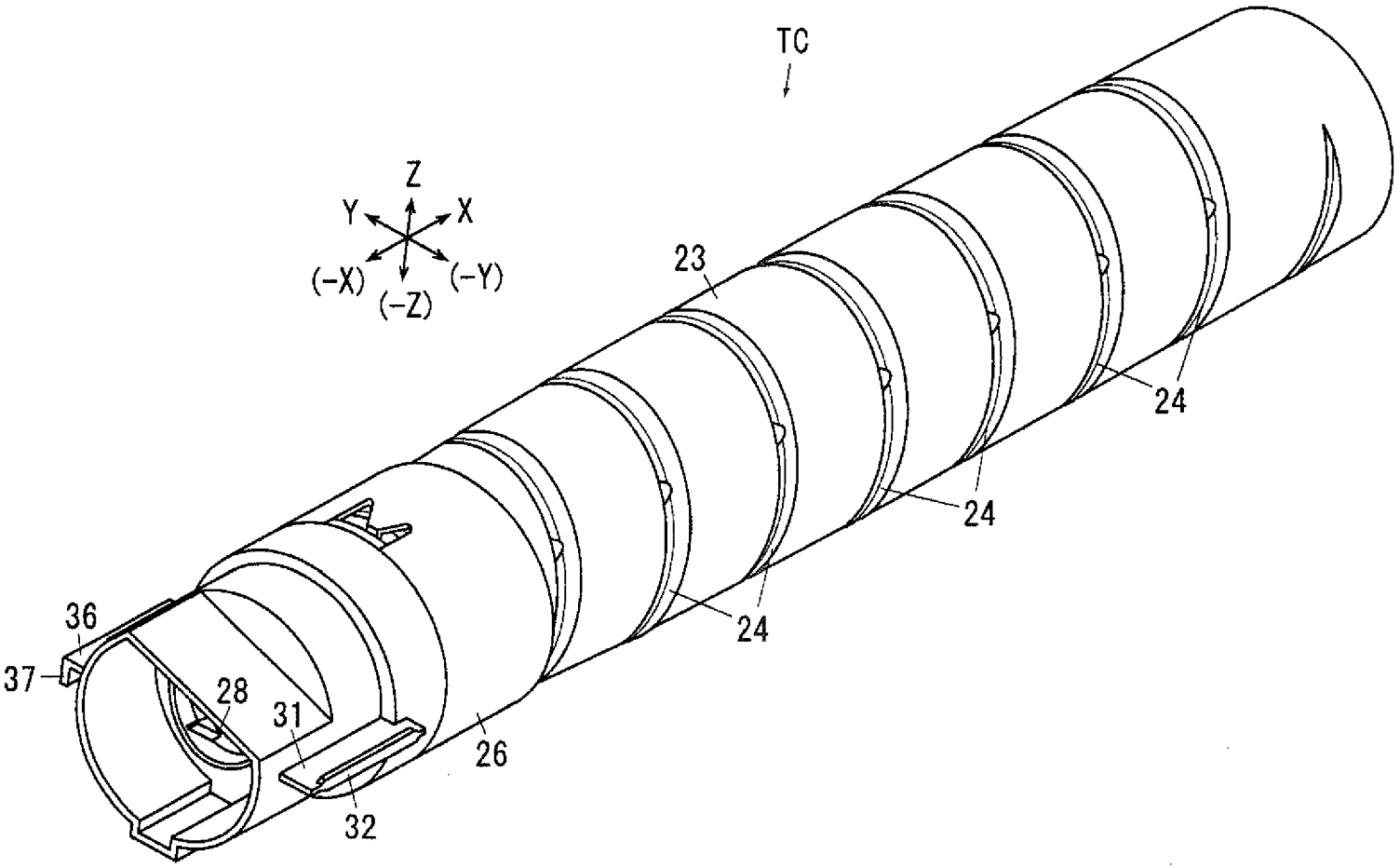
FIG. 8 is an enlarged view of the inside of a developer vessel of Example 1.

FIG. 8 is an enlarged view of the inside of a developer vessel of Example 1.

In FIGS. 3 to 7, the toner cartridge Kk of Example 1 is configured to have a cylindrical shape extending in the frontward-rearward direction. The toner cartridge Kk includes, at a front end, a handle 21 as an example of a grip portion. A circular cylindrical cover portion 22 extending in the frontward-rearward direction is provided on the rear side of the handle 21.

In FIG. 8, a bottle main body 23 as an example of a container is accommodated inside the cover portion 22. A spiral groove 24 as an example of a transport portion is formed in the bottle main body 23. A supply portion 26 is supported at a rear end portion of the bottle main body 23. The supply portion 26 supports the bottle main body 23 in a rotatable manner. A discharge port 26*a* is formed to correspond to flowing into the holder portion 1 is formed in a bottom portion of the supply portion 26. A shutter 27 as an example of an opening-closing member is supported in the bottom portion of the toner cartridge Kk so as to be movable in the frontward-rearward direction. The shutter 27 allows the discharge port 26*a* to be opened when the toner cartridge Kk is mounted in the developer supply device U3*b* and the discharge port 26*a* to be closed when the toner cartridge is removed from the developer supply device U3*b*.

A coupling 28 as an example of a drive target portion is supported by the supply portion 26. The coupling 28 is connected to the bottle main body 23. The coupling 28 is connected to a supply motor or the like at the rear end of the holder portion 1 in a case where the toner cartridge Kk is mounted on the developer supply device U3*b*. Thus, the coupling 28 and the bottle main body 23 are configured to be driven by the drive of the supply motor. In FIG. 4, in Example 1, during the drive of the supply motor, a rotating direction of the bottle main body 23 is set such that the bottle main body rotates in a clockwise direction Ya in FIG. 4.

In FIGS. 3 to 6, a left guide rib 31 as an example of a first protrusion is supported, as an example of a guide target portion, in an upper left portion of the cover portion 22. In FIG. 3, the left guide rib 31 is formed to have a plate shape extending in the frontward-rearward direction. The left guide rib 31 is formed to have a thickness with which the left guide rib passes through the slit portion 7 so as to be guided. In Example 1, as illustrated in FIG. 3, the left guide rib is formed at two front and rear positions; however, the configuration is not limited thereto, and it is possible to employ a configuration in which one guide rib extends in the frontward-rearward direction.

The left guide rib 31 of Example 1 extends from an outer surface toward the outer side of the cover portion 22. As illustrated in FIG. 4, in a case where there is assumed a virtual line L1, which passes through a rotating axis 23*a* and is parallel to the discharge port 26*a* on a plane perpendicular to the rotating axis 23*a* of the bottle main body 23, the left guide rib 31 extends in a direction parallel to the virtual line L1.

In addition, the left guide rib 31 of Example 1 is disposed on the upper side with respect to the virtual line L1.

A left protrusion 32 as an example of a first extending portion is formed at the outer end of the left guide rib 31. The left protrusion 32 extends along the left guide rib 31 in the frontward-rearward direction. The left protrusion 32 is configured to be accommodated and to be guided inside the left rail main body 8. The left protrusion 32 of Example 1 extends toward the downstream side in the rotating direction Ya of the bottle main body 23.

In FIGS. 4 and 7, a right guide rib 36 as an example of a second protrusion is supported, as an example of a guide target portion, in a lower right portion of the cover portion 22. Similar to the left guide rib 31, the right guide rib 36 is formed to have a plate shape extending in the frontward-rearward direction. The right guide rib 36 is formed to have a thickness with which the right guide rib passes through the slit portion 12 so as to be guided. Similar to the left guide rib 31, the right guide rib 36 of Example 1 extends in the direction parallel to the virtual line L. The right guide rib 36 of Example 1 is disposed on the lower side with respect to the virtual line L1.

A right protrusion 37 as an example of a second extending portion is formed at the outer end of the right guide rib 36. Similar to the left protrusion 32, the right protrusion 37 extends along the right guide rib 36 in the frontward-rearward direction. The right protrusion 37 is configured to be accommodated and to be guided inside the right rail main body 13. Similar to the left protrusion 32, the right protrusion 37 of Example 1 extends toward the downstream side in the rotating direction Ya of the bottle main body 23.

Operation of Example 1

Figure 9:
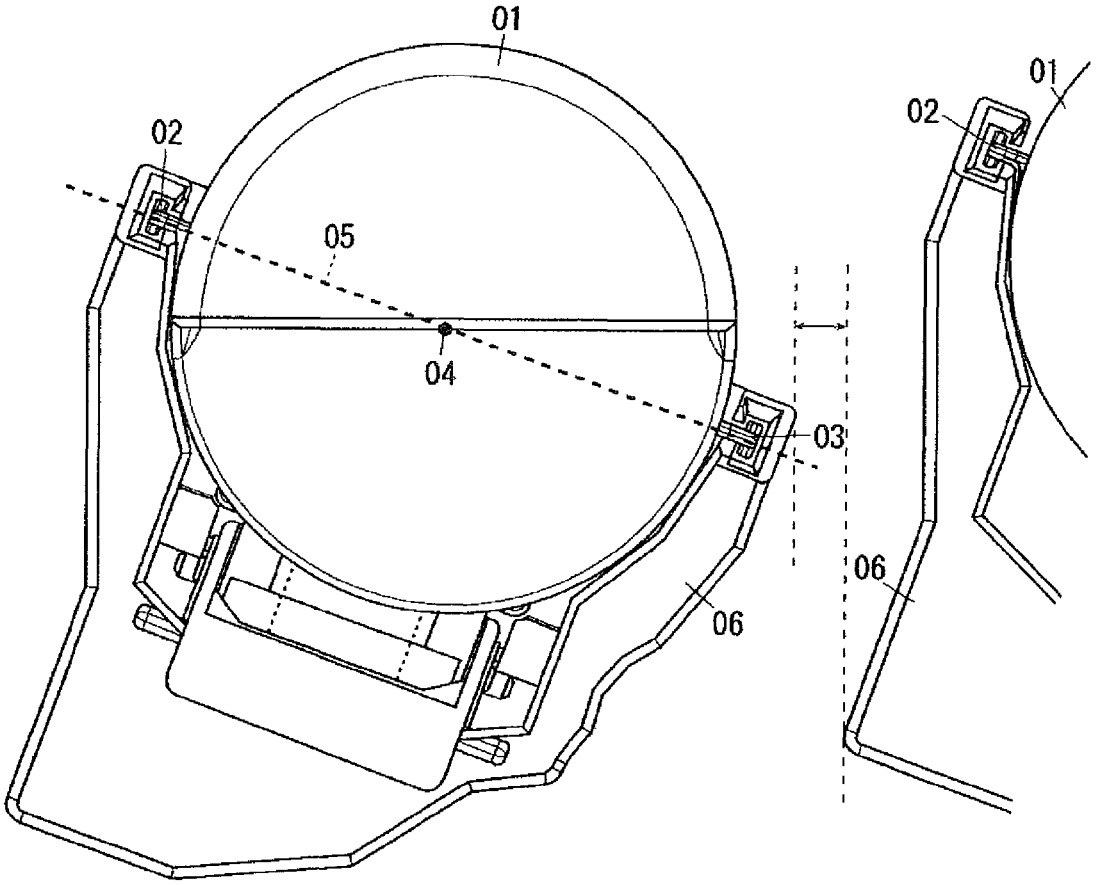
FIG. 9 is a view depicting a configuration of a toner cartridge in the related art.

FIG. 9 is a view depicting a configuration of a toner cartridge in the related art.

In the copier U of Example 1 having the configuration described above, when the toner cartridges Ky to Kk are attached or detached, the guide ribs 31 and 36 and the protrusions 32 and 37 are guided through the guide rails 6 and 11.

In FIG. 9, in a toner cartridge 01 in the related art, in some cases, guide ribs 02 and 03 are disposed on an extended line of a virtual line 05 that passes through the rotation center 04 of a rotating transport member such as a bottle main body or an agitator and is parallel to a discharge port. In a configuration illustrated in FIG. 9, the guide rib 02 protrudes from both side of the toner cartridge 01 and thus, a problem arises in that the toner cartridge 01 is increased in size, that is, in external size. In addition, when the external size of the toner cartridge 01 is increased, a holder portion 06 that is mounted in the toner cartridge 01 is also increased or there is also a need to secure a certain space between the holders portion 06. Hence, an entire size of an image forming apparatus is increased or the increased size has an adverse effect on a disposition or a layout of the holder portions 06, the number of the mountable holders, or the like. Further, a frame that accommodates the toner cartridge 01 is increased, and thus a problem arises in that the toner cartridge occupies a space in a case of being stored in a stacked manner in a warehouse.

As disclosed in a configuration in JP-A-2003-295591, a problem arises in that an external size of a toner cartridge is increased also in a configuration of having a flange shape protrusion.

Figure 10:
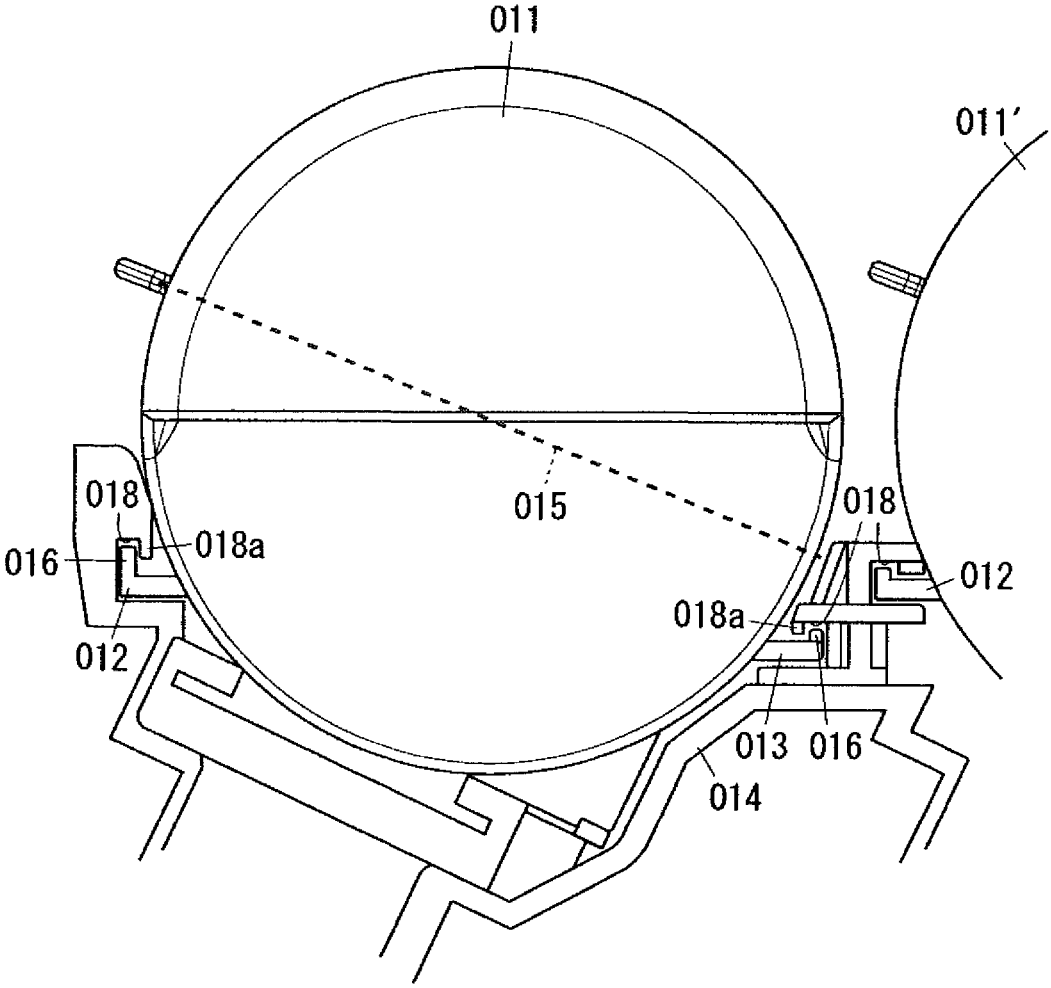
FIG. 10 is a view depicting a configuration of another toner cartridge in the related art, which is different from that in FIG. 9.

FIG. 10 is a view depicting a configuration of another toner cartridge in the related art, which is different from that in FIG. 9.

In FIG. 10, in another toner cartridge 011 in the related art, which is different from that in FIG. 9, the guide ribs 012 and 013 are disposed on the same side (lower side) with respect to a virtual line 015. In the configuration illustrated in FIG. 10, the external size is likely to be decreased, compared to the configuration illustrated in FIG. 9. However, as illustrated in FIG. 10, in adjacent toner cartridges 011 and 011', the right-side guide rib 013 of the left-side toner cartridge 011 and the left-side guide rib 012 of a right-side toner cartridge 011' are closer to each other, compared to a case in FIG. 9. Thus, there is a need to have a certain size so as to secure a shape or the strength of a holder portion 014. Hence, eventually, problems arise in that it is difficult to reduce the entire size of the image forming apparatus or there is a restriction on a disposition of the toner cartridges 011 and 011' or a design of a developer supply device.

Similar to the case illustrated in FIG. 10, a configuration disclosed in JP-A-2004-138694 also has a problem in the disposition of toner cartridges and the design of a developer supply device due to a protrusion.

Figure 11:
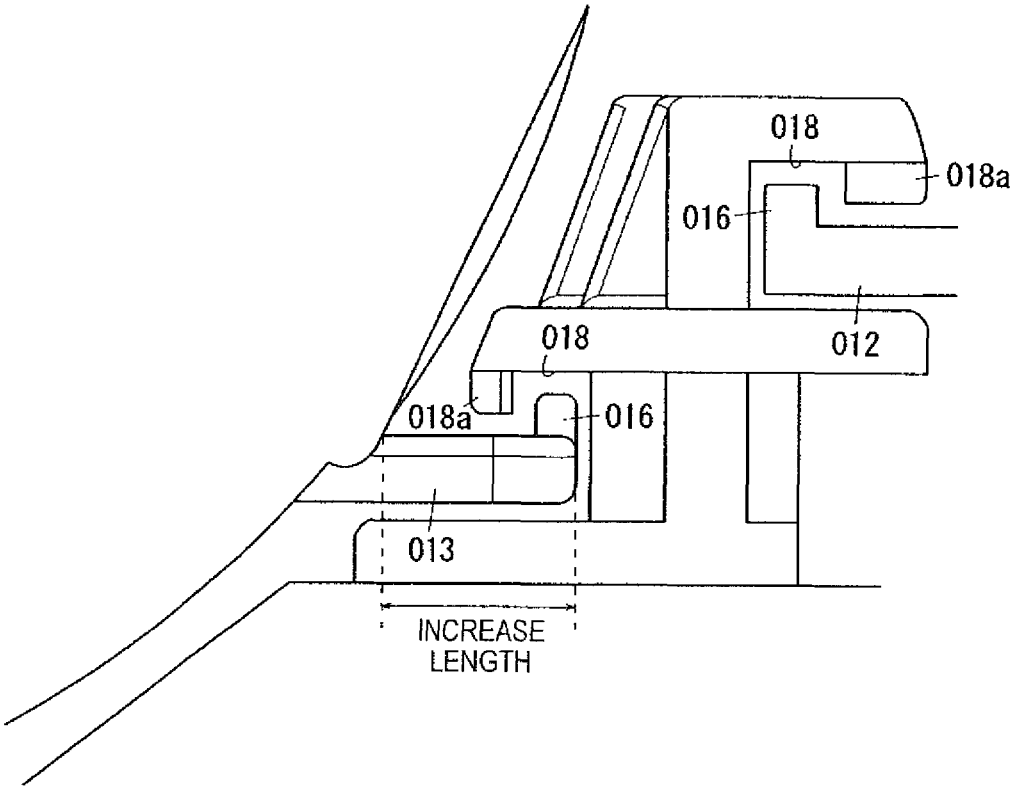
FIG. 11 is an enlarged view of a major part of a portion of guide ribs of the toner cartridge in the related art illustrated in FIG. 10.

FIG. 11 is an enlarged view of a major part of a portion of the guide ribs of the toner cartridge in the related art illustrated in FIG. 10.

In FIGS. 10 and 11, each of the guide ribs 012 and 013 has a protrusion 016 formed to be bent from an outer end of one guide rib to the virtual line 015 side. As disclosed in the configuration in JP-A-2004-138694, in a configuration in which the protrusion 016 is not provided, when the toner cartridge is attached or detached, there is a possibility that the guide ribs 012 and 013 are likely to slip out from a guide rail 018 due to playing and backlash.

Here, as illustrated in FIGS. 10 and 11, in a case where the protrusion 016 is provided to protrude to the virtual line 015 side, the guide ribs 012 and 013 need to be increased in length in order to secure a certain thickness and strength in a claw portion 018*a* of the guide rail 018 as illustrated in FIG. 11. Hence, in the configurations illustrated in FIGS. 10 and 11, a protruding length on the outer side of the guide ribs 012 and 013 is likely to be larger than that of the configuration illustrated in FIG. 9. Accordingly, the guide ribs 012 and 013 are likely to be broken if the guide ribs 012 and 013 contact with a desk during replacement of the toner cartridge 011 or if the toner cartridge 011 falls down during the product distribution of the toner cartridge.

Further, when a transport member of the toner cartridge 011 rotates, the toner cartridge 011 also receives a force of rotating. As illustrated in FIG. 11, in a case where both of the protrusions 016 of the guide ribs 012 and 013 protrude to the virtual line 015 side, one protrusion 016 is caught in the guide rail 018 in the rotating direction, but the other protrusion 016 is disposed in an opposite direction to a catching direction in the guide rail 018. Hence, there is a concern that the other protrusion 016 will slip out from the guide rail 018, depending on a manufacturing error or an individual difference of the guide rail 018 or the protrusion 016, or a size of backlash. When the protrusion 016 slips out from the guide rail 018, a problem arises in that the discharge port of the toner cartridge 011 is incompletely connected to an inlet port of a holder portion and thus, developer leaks from the incomplete connection.

In this respect, the toner cartridges Ky to Kk of Example 1 are arranged on the opposite side from each other with the virtual line L1 being interposed between the guide ribs 31 and 36. Hence, it is difficult for the external size of the toner cartridges Ky to Kk to be increased, compared to the configuration illustrated in FIG. 9. In addition, compared to the configuration in the related art illustrated in FIG. 10, the guide ribs 31 and 36 of the adjacent toner cartridges Ky to Kk are vertically separated from each other such that it is difficult to be close in the rightward-leftward direction as illustrated in FIG. 4. Accordingly, the developer supply device U3*b* and the copier U are likely to be miniaturized as a whole. In addition, compared to the configuration illustrated in FIG. 10, the need to secure a space between the holder portions 1 is reduced and restrictions on the design and the layout are reduced.

In addition, the toner cartridges Ky to Kk of Example 1 have the protrusions 32 and 37 formed on the guide ribs 31 and 36. Hence, the guide ribs 31 and 36 are less likely to slip out from the guide rails 6 and 11, compared to technology disclosed in JP-A-2004-138694 in which the protrusions 32 and 37 are not formed.

Further, the toner cartridges Ky to Kk of Example 1 have the protrusions 32 and 37 extending toward the downstream side in the rotating direction Ya of the bottle main body 23. Hence, it is possible to shorten the length of the guide ribs 31 and 36 as illustrated in FIG. 7, compared to a case where both of the protrusions 32 and 37 extend toward the virtual line L1. Accordingly the guide ribs 31 and 36 are less likely to be broken.

In addition, in the toner cartridges Ky to Kk of Example 1, although the toner cartridges Ky to Kk also receive the rotating force when the bottle main body 23 rotates, the protrusions 32 and 37 are caught in the rail main bodies 8 and 13. Accordingly, during the use of the toner cartridges Ky to Kk, the toner cartridges Ky to Kk are less likely to slip out from the holder portions 1, compared to the configuration illustrated in FIG. 10.

Modification Example

As described above, an example of the invention is described; however, the invention is not limited to the examples described above, and it is possible to perform various modifications within a range of the gist of the invention described in the scope of the claims.

Modification examples (H01) to (H04) of the invention are listed below.

(H01) In the examples described above, the configuration of the copier U as an example of the image forming apparatus is described as an example; however, the configuration is not limited thereto, and it is possible to be applied to a FAX machine or a multifunction device having multiple functions of the copier and the FAX machine. In addition the invention is not limited to the multicolor developing image forming apparatus, and it is possible to employ a configuration of a single-color, so-called monochromatic image forming apparatus. The invention is not limited to a so-called tandem type image forming apparatus, and it is possible to be applied to a rotary type image forming apparatus.

(H02) In the examples described above, it is desired that the protrusions 32 and 37 are configured to protrude toward the downstream side in the rotating direction Ya; however, it is possible to be configured to protrude toward the upstream side thereof.

(H03) In the examples described above, the configuration, in which the two guide ribs 31 and 36 are disposed on the upper left and lower right sides, is described as an example; however, the configuration is not limited thereto. For example, it is possible to dispose the guide ribs in a combination of the lower left and upper right sides. In addition, it is desired that at least the two guide ribs 31 and 36 are provided; however, three or more guide ribs can be provided.

(H04) In the examples described above, the configuration, in which the spiral groove 24 formed in the bottle main body 23 rotates such that the developer is transported, is described as an example; however, the configuration is not limited thereto. For example, the invention can be applied to a configuration in which a transport member in which a spiral or inclined transporting vane is supported on a rotating shaft or a coil spring shape transport member having a wire wound in a spiral shape rotates such that the developer is transported.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer vessel comprising:

a container that contains developer and includes a discharge port through which the developer is discharged, and a transport portion that rotates to transport the developer toward the discharge port;

a first protrusion that protrudes from an outer surface of the container;

a second protrusion that protrudes from the outer surface of the container at a position on an opposite side to the first protrusion with a virtual line being interposed between the first and second protrusions, wherein the virtual line passes through a rotational axis of the transport portion and on a plane perpendicular to the rotational axis of the transport portion and is parallel to the discharge port; and an extending portion that is disposed at an outer end of each of the first and second protrusions on the plane perpendicular to the rotational axis and that extends in a direction intersecting with the respective first and second protrusions and in a direction of being apart from the virtual line.

2. The developer vessel according to claim 1, wherein the extending portion extends toward a downstream side in a rotating direction of the transport portion on the plane perpendicular to the rotational axis.

3. An image forming apparatus comprising:

an image carrier;

a latent image forming device that forms a latent image on a surface of the image carrier;

a developing device that develops the latent image on the surface of the image carrier into a visible image;

the developer vessel according to claim 1 that contains developer that is supplied to the developing device;

a transfer device that transfers the visible image on the surface of the image carrier to a medium; and a fixing device that fixes the visible image to a surface of the medium.

* * * * *